US009544951B1

(12) United States Patent
O'Neil et al.

(10) Patent No.: US 9,544,951 B1
(45) Date of Patent: Jan. 10, 2017

(54) PROGRAMMABLE LED DRIVER

(71) Applicants: Tom O'Neil, Gardena, CA (US); Lee Chiang, Sylmar, CA (US)

(72) Inventors: Tom O'Neil, Gardena, CA (US); Lee Chiang, Sylmar, CA (US)

( * ) Notice: Subject to any disclaimer, the term of this patent is extended or adjusted under 35 U.S.C. 154(b) by 0 days.

(21) Appl. No.: 14/812,073

(22) Filed: Jul. 29, 2015

(51) Int. Cl.
*H05B 33/08* (2006.01)

(52) U.S. Cl.
CPC ..... *H05B 33/0809* (2013.01); *H05B 33/0845* (2013.01)

(58) Field of Classification Search
None
See application file for complete search history.

(56) References Cited

U.S. PATENT DOCUMENTS 8,344,639 B1 * 1/2013 Bahrehmand ..... H05B 33/0845 315/247
2014/0209035 A1 * 7/2014 Tang ..... A01K 1/03 119/267

* cited by examiner

*Primary Examiner* — Dedei K Hammond
(74) *Attorney, Agent, or Firm* — Clement Cheng

(57) ABSTRACT

An LED driver comprising a first stage, wherein the first stage converts AC power from an AC power source into a DC power source. A second stage receiving the DC power source from the first stage and further comprising: a second stage step-down buck converter with a constant current output that receives power from the DC power source; and a second stage intelligent step-down LED driver chip that runs a step down buck converter that produces the constant current output to the external LED load. A companion microcontroller controls a second stage intelligent step down LED driver chip. The companion microcontroller provides programmable features for a user, wherein the programmable features provide user programmable variables to reprogram the LED Driver to alter default variables.

7 Claims, 5 Drawing Sheets

PROGRAMMABLE LED DRIVER

FIELD OF THE INVENTION

The present invention is in the field of LED drivers, namely programmable LED drivers.

DISCUSSION OF RELATED ART

A variety of different LED drivers have been made to be programmable. For example, U.S. Pat. No. 8,344,639 issued Jan. 1, 2013, to Bahrehmand, entitled Programmable LED Driver, the disclosure of which is incorporated herein by reference, provides drivers with a programmable integrated circuit adapted to a capacitive touch pad sensor that is a touchpad slider to provide dimming. U.S. Pat. No. 8,575,851 issued Nov. 5, 2013, entitled Programmable LED Driver, to inventor Bahrehmand also provides for a microprocessor that allows for a touchpad to dim the driver, the disclosure of which is incorporated herein by reference.

Inventor Muthu describes a device for controlling and adjusting a display light for a retail display system that has a computer associated with multiple light sources for adjusting the light sources using a feedback loop, in U.S. Pat. No. 6,510,995, entitled RGB LED Based Light Driver Using Microprocessor Controlled AC Distributed Power System, which was issued in Jan. 28, 2003, the disclosure of which is incorporated herein by reference.

Inventor Tikkanen in U.S. Pat. No. 8,525,446 provides for a Configurable LED Driver/Dimmer For Solid State Lighting Applications issued Sep. 3, 2013, the disclosure of which is incorporated herein by reference. Tikkanen suggests that a secondary controller can transmit LED control information to control outputs of the set of output current drivers.

SUMMARY OF THE INVENTION

An LED driver comprising a first stage, wherein the first stage converts AC power from an AC power source into a DC power source. A second stage receiving the DC power source from the first stage and further comprising: a second stage step-down buck converter with a constant current output that receives power from the DC power source; and a second stage intelligent step-down LED driver chip that receives the constant current output from the second stage step down buck converter. A companion microcontroller controls a second stage intelligent step down LED driver chip. The companion microcontroller provides programmable features for a user, wherein the programmable features provide user programmable variables to reprogram the LED Driver to alter default variables.

The microcontroller further includes multiple input/output (I/O) pins that communicate with the companion microcontroller. The companion microcontroller reads a user supplied resistor Rset for LED current programming setting. The companion microcontroller reads a 0-10 VDC analog dimming signal, and the companion microcontroller reads a negative temperature coefficient resistor for programmable temperature derating. The microcontroller is configured to read an optional LED current setting resistor Rset, and a firmware determines an LED current setting by an internal data table in EEPROM. The LED current setting on the microcontroller provides a pulse width modulation (PWM) signal, filtered by a resistor capacitor to a second stage intelligent step down LED driver chip LED current analog dimming output pin "IADJ". The user input 0-10 VDC analog dimming is also read by the Microcontroller, which is converted into PWM signal, per 4 types of available dimming curves (linear, logarithm, S-Curve or Inverse profiles) and then sent to LED Driver chip analog dimming control pin IADJ, which controls the LED output current accordingly.

If the Rset value is less than 8.3K Ohm, the programmable maximum output current function, determined by the Rset value and internal Firmware EEPROM data, overrides the GUI Iout settings stored in EEPROM. This programmed maximum output current value is then controlled by the 0-10V input from 0% to 100% Output. The microcontroller has an EEPROM that provides a data table storage of factory default and user programmable parameters. Programmable parameters can be read and modified, then reprogrammed by a graphic user interface (GUI) software program via a universal serial bus port on a computer with a USB to I2C interface converter. The USB-to-I2C interface converter outputs I2C communication signals as SDA and SCL to the microcontroller to control LED output or alter the programmable data in the EEPROM data area. A graphic user interface software can communicate with the LED driver to read existing programmable parameters. A microcontroller EEPROM data table stores programmable parameters including a maximum LED current parameter that is no higher than a buck converter hardware design limit and an Rset value or GUI set maximum value.

The negative temperature coefficient (NTC) resistor controls programmable temperature derating. GUI Programmable values for NTC are Temperature Derating Sart (Ohms), Temperature derating End (Ohms) and Minimum Output Level (% of max). The microcontroller (MCU) continuously reads the resistance value of the NTC on the input connector, if an NTC resistor is not installed, or is installed but the value is higher than default maximum 6.3K Ohm or a user programmed value via the GUI, the LED output current is in normal mode which is determined by the GUI Set Value or Rset value (Which Overides GUI when present and <8.3K Ohms), or 0-10V analog dimming input voltage. When an ambient temperature increases and a NTC resistance value drops below the maximum value set by the GUI, then the microcontroller reduces the LED output current into a temperature derating mode according to the internal EEPROM data and MCU formula based on the NTC temperature resistance value. The NTC temperature derating is programmable via GUI, to select a maximum resistance where the LED current begins to fall back and the minimum resistance where the LED current is held on at GUI programmed minimum value.

Figure 1:
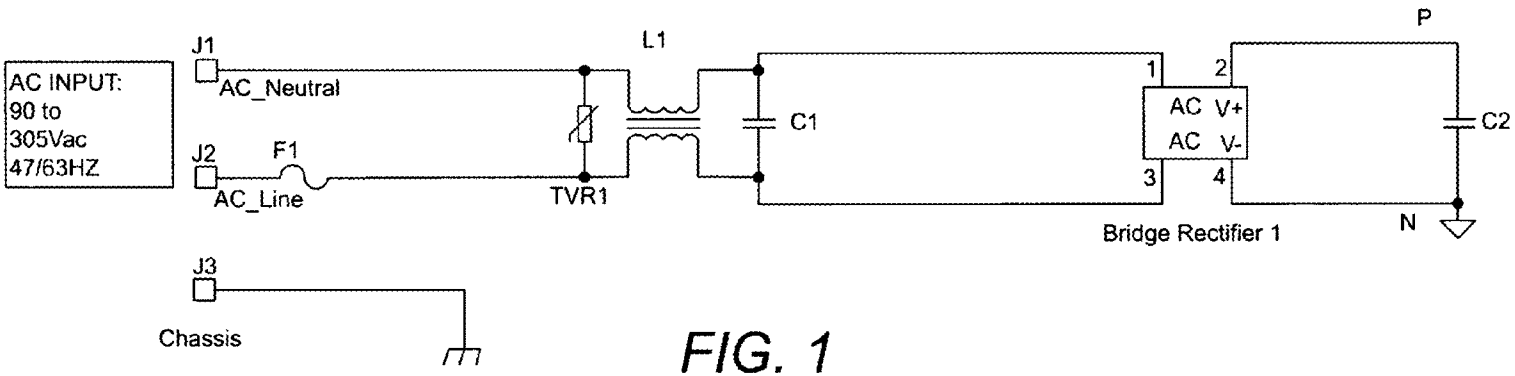
FIG. 1 is a circuit diagram of the present invention showing a general overview of the AC side of the circuit from the AC input to the bridge rectifier.

The following call out list of elements can be a useful guide in referencing the element numbers of the drawings. The callout list of elements is presented generally in the order that the elements are shown in the drawings.

101 Transition-Mode PFC Controller U2 STMicroelectronics™ part number L6562
102 intelligent step-down LED driver chip U1 such as Texas Instruments™ part number TPS92640
106 IADJ pin on U1 for current (I) adjustment
107 Analog Dim Signal (wire continues across FIGS.
108 PWM Dim Signal (wire continues across FIGS.
109 RC network
110 external LED load
116 UDIM pin on the LED driver U1 chip
117 LED+__OUT LED positive output terminal at connector J4
128 Riadj1 first current adjusting resistor
129 Riadj3 third current adjusting resistor
130 U1 VREF pin Reference Voltage Pin
131 Riadj2 second current adjusting resistor
134 U1 VOUT pin, a Voltage Reference Pin
135 first voltage output resistor Rvout1
136 second voltage output resistor Rvout2
103 +3.3 VDC voltage regulator U3
104 EEPROM U5 such as STMicroelectronics™ part number M24C02WP.
105 companion microcontroller U4 such as ST Microelectronics™ part number STM32F030F4P6
115 Analog_Dimming
118 Rvout3 voltage divider top resistor
119 Rvout4 voltage divider bottom resistor
120 Rvout5 low pass filter resistor
121 Cvout_sense low pass filter capacitor
122 Vout_Sense Sensing Output Voltage
132 Dvee VEE voltage isolation Diode
137 R_Dimming (from FIG. 4 top side of cap Crset)
139 Dntc1 Protection Diode
138 Rntc1 Pull up resistor
133 NTC Negative Temperature Coefficient Resistor (Temperature Sensor)
140 Cntc Noise Filter for NTC_P output to processor
123 Rset LED current programming Set resistor
124 Rrset1 Pull up resistor
125 Rrset2 low-pass filter resistor
126 Crset low-pass filter capacitor
111 Analog Dim (0-10 VDC)
112 Radim2 voltage divider top resistor
113 Radim3 voltage divider bottom resistor
114 Cadim noise filter

GLOSSARY FOR VERIFICATION

TVR1: Transient Voltage Suppressor. To absorb any high voltage spikes coming from the AC power line, such as someone switch ON or OFF high power devices nearby.
L1: Common Mode Choke
F1: Fuse on the AC line to protect circuitry.
C1: capacitor across the AC power lines to filter some noise on the AC lines.
P: A netlist name assigned as "P", to indicate the "positive" high voltage after the Bridge Rectifier 1.
N: A netlist name assigned as "N", to indicate the "negative" high voltage after the Bridge Rectifier 1.
TI: an abbreviation for Texas Instruments™, a semiconductor manufacturer

SPECIFICATION ABBREVIATIONS

LED light emitting diode
GUI graphical user interface
MCU microcontroller
USB Universal serial bus
NTC negative temperature coefficient
PFC power factor correction
THDi current (i) total harmonic distortion
THD total harmonic distortion
PWM pulse width modulation
IADJ current adjustment
EEPROM electrically erasable programmable read-only memory
SDA serial data
SCL serial clock
ADC analog-to-digital converter
POC Programmable Output Current
I2C or $I^2C$ inter-integrated circuit, $I^2C$ read as "I-square-C"
RC network Resistor/Capacitor network
I/O input/output The present invention is a programmable LED driver. FIG. 1 describes the AC side of the device up to immediately after the bridge rectifier. The LED driver has various standard components such as a common mode choke L1, FIG. 1 with 2 windings in opposite directions on the same core, to generate opposite magnetic field to "cancel" out switching noise on the AC power lines for use as a standard Electro-Magnetic Interference (EMI) filter. The Bridge Rectifier 1 provides a positive and negative voltage to P and N on the circuit diagram. The P and N of FIG. 1 are same points as the P and N of FIG. 2 and could be physically embodied as wire solder junctions.

The newly developed programmable LED driver has industrial standard 0-10 VDC analog dimming with the additional following nine programming features: First, a user can provide a preset maximum LED current when analog dimming voltage Vdim=10V or at some other preselected max Vdim voltage, using a computer Graphic User Interface (GUI) software and a USB interface cable. Secondly, a user can use a computer GUI software and USB interface cable to preset a minimum LED current such as a percentage ratio of maximum LED current when analog dimming voltage Vdim=0V or preselected min Vdim voltage. Third, with previously preset maximum LED current by GUI, the LED maximum current can be adjusted easily by users with only an external current set resistor Rset 123. Fourth, Rset has an override feature. If an Rset 123 resistance value is greater than a certain value, such as greater than 8.3K OHM or open where Rset 123 is not installed, then the previously maximum LED current set by GUI is selected. Alternatively, If an Rset 123 resistance value is lesser than a certain value, such as lesser than 8.3K OHM, the programmable maximum output current function, determined by the Rset value and internal Firmware EEPROM data, overrides the GUI Iout settings stored in EEPROM. This programmed maximum output current value is then controlled by the 0-10V input from 0% to 100% Output. Fifth, the 0-10 VDC analog dimming Vdim_Vs_LED current is user selectable via GUI with several options, such as linear, logarithm, S-Curve or Inverse profiles. Sixth, a user can disable the dimming function by GUI. Seventh, with an external Negative Temperature Coefficient (NTC) resistor, the user can program the LED Driver overheat drawback curve, from starting drop LED current to lowest LED current, to protect both LED Driver and LED lamps. This is a temperature "derating" programmable feature. Seventh, a built-in default NTC derating curve is provided so that the user just needs to select a proper NTC resistance value and proper resistance at desired fall back and minimum temperature to program the desired temperature derating curve.

Eighth, the user can also change the default NTC curve via GUI, by selecting an NTC minimum resistance and maximum resistance. Ninth, the corresponding NTC minimum LED current (in percentage % ratio to maximum LED current) is also programmable via GUI.

The design is implemented in two stages. The first stage is a constant voltage flyback switching power supply and powered by AC power source 90 to 305 VAC at 47 to 63 Hz input. The first stage design uses an LED driver chip U2 101 such as STMicroelectronics™ part number L6562 which has high Power Factor Correction (PFC) and low AC current Total Harmonics Distortion (THDi). The output DC voltage will be the main power source of the second stage, which is a step-down buck converter in constant current mode. The second stage intelligent step-down LED driver chip U1 102 can be Texas Instruments™ part number TPS92640 that has both analog and digital dimming input signals. The dimming and programmable functions are implemented in the second stage which implements the nine features previously described above. Texas Instruments (TI) part number TPS9260, is programmable with an companion Microcontroller U4 105 (STMicroelectronics part number STM32F030F4P6) for multiple programmable features.

The intelligent step-down LED driver chip 102 at location U1 can dim the LED output using a standard Pulse Width Modulation (PWM) signal 108 applied on the UDIM pin 116. The microcontroller U4 105 can be implemented as STMicroelectronics™ part number STM32F030F4P6 and have firmware that can send a PWM signal 108 to the intelligent step-down LED driver chip U1 102 to dim the LED. The PWM signal 108 can have a name such as PWM_Dim. The intelligent step-down LED driver chip U1 102 can also dim the LED output by analog signal applied on IADJ pin. The Microcontroller U4 105 with firmware can send a PWM signal named Analog_Dim 107 to a Resistor/Capacitor network (RC Network 109), which integrates the PWM signal named Analog_Dim 107 into an analog signal after signal re-shaping by RC Network 109, then to the intelligent step-down LED driver chip U1 102 on IADJ pin 106 to dim the LED.

The microcontroller U4 105 may have proprietary firmware and have a variety of input/output pins to handle proper GUI input signals and output the PWM dimming (PWM_Dim 108) and analog dimming (Analog_Dim 107) signals to the intelligent step-down LED driver chip U1 102. In the Microcontroller U4's 105 internal and or external U5 104 "Electrically Erasable Programmable Read Only Memory" (EEPROM) area, a table contains registered default settings of all the programmable parameters, such as the max Vdim voltage for reaching a hardware designed maximum LED output current as described above. The table can also have a minimum LED percentage ratio to the hardware designed minimum LED output current.

The 0-10 VDC Vdim input signal, Analog Dim (0-10V DC) 111, is divided down below 3.3 VDC become signal Analog_Dimming 115 using a pair of resistors Radim2 112 and Radim3 113 and fed to the Microcontroller U4 105 analog input pin PAL The firmware can convert the input signal into digital data via an internal built-in Analog-to-digital converter (ADC). Using the digital data information, the firmware can calculate the proper PWM signal according to the pre-calculated table for linear/logarithm/s-cure/inverse dimming curves, and then send the proper PWM signal to the RC Network 109 to generate the true analog dimming signal for the intelligent step-down LED driver chip U1 102 IADJ input pin 106 to implement the 0-10 VDC dimming.

An interesting design note is that the PWM dimming would "chop" the LED output current ON and OFF very fast, usually higher than 200 Hz. Although most people would not notice a 200 Hz or higher frequency "flickering", this is not the desired dimming of the present invention. The preferred dimming is by using the analog dimming on the IADJ pin 106. Note that the intelligent step-down LED driver chip U1 102 has a "UDIM" pin which provides a built-in function for Pulse Width Modulation (PWM dimming), but the UDIM pin is not used for PWM dimming in this invention because Analog_Dim signal 107 is used to dim instead of the UDIM pin. The UDIM pin is used in the present invention for an overvoltage or shutdown function. The PWM_Dim signal 108 is used to shutdown LED output by setting it at logic 0 or 0 VDC continuously when U4 105 pin PA4 having a signal name of Vout_Sense 122 reads as too high, which means LED output voltage at +Vout is in a state of overvoltage. +Vout voltage is divided down below 3.3 VDC signal Vout_Sense 122 using a pair of resistors Rvout3 118 and Rvout4 119, and filtered by low-pass RC filter resistor Rvout5 120 and capacitor Cout_sense 121, and the signal Vout_Sense 122 is fed to the Microcontroller U4 105 analog input pin PA4.

With the built in PWM dimming unused by setting it at a maximum 100% duty cycle continuously (not in the shutdown state), the Microcontroller U4 105 can read the Rset 123 resistance value. The external Rset resistor 123 is connected from the Rset 123 input pin (at connector J7) to ground pin (at connector J9) and both are accessible by a user from connector pins. If the Rset is installed with less than the preselected maximum value about 9.1K OHM, then the Rset value will be read by Microcontroller U4 105 with pullup resistor Rrset1 124 to 3.3 VDC and filtered by low-pass RC filter resistor Rrset2 125 and capacitor Crset 126. The LED maximum current will be selected by the firmware so that it is always equal or less than the hardware designed maximum LED output current.

The built in PWM dimming is unused by having it set at maximum 100% duty cycle continuously (not in the shutdown state) and the Rset resistance value is lower than 8.3K OHM, the Microcontroller U4 105 can take override action to ignore the LED out current per the GUI selected four types of dimming curve (linear/logarithm/S-Curve/Inverse). The programmable maximum output current function, determined by the Rset value and internal Firmware EEPROM data. This programmed maximum output current value is then controlled by the 0-10V input from 0% to 100% Output.

The built in PWM dimming is unused by having it set at maximum 100% duty cycle continuously (not in the shutdown state) and the Rset resistance value is higher than 8.3K OHM, the Microcontroller U4 105 will take the default LED out current per the GUI selected four types of dimming curve (linear/logarithm/S-Curve/Inverse). There are four "check boxes" for these four types of dimming curves. Any of these four types can be disabled by unchecking or unselecting the individual box in the GUI to avoid a user accidentally selecting an undesired dimming curve.

When PWM dimming is unused or set at a maximum 100% duty cycle continuously (not in the shutdown state), a Programmable Output Current (POC) is available. If the optional Rset 123 resistor is installed and is less than the max 8.3K OHM, the Microcontroller U4 105 can calculate the desired maximum LED current using pre-loaded "Output Current Vs. Rset (ohm)" data formula stored in the Microcontroller U4 105 EEPROM, or external. EEPROM U5 104 At this point, the 0-10 VDC dimming function is enabled. The Rset overrides the GUI settings feature when Rset is less than a predetermined 8.3K Ohm resistance value. If the Rset value is greater than 8.3K Ohm or not installed, the maximum LED output current will be the default GUI setting.

The minimum dimmed LED percentage (ratio of Vdim=0 VDC or programmed minimum) can also be programmed in to EEPROM table. Whenever the Microcontroller U4 105 reads the 0-10 VDC input voltage as equal or less than approximately 1V the minimum LED Iout percentage value or the actual LED current is set by firmware to stay at this minimum GUI set dimming LED current.

The 0-10 VDC analog dimming in general has a tendency to cause LEDs to flicker when the dimming level nears 0%. Therefore, an "Analog Dimming Min (%)" feature can be added in the GUI. The user can change the default 0.5% to any other non-zero value to ensure their LED lamps will not run into flickering problem at this minimum 0-10 VDC analog dimming level at or close 0V. The GUI also has a disable dimming check box, if the disable dimming check box is checked by a mouse click, the dimming function can be disabled regardless the previous settings of the dimming. The EEPROM data table can also store additional information for the programmable LED driver, such as model ID, lot and date code, and manufacturer and serial number.

Figure 5:
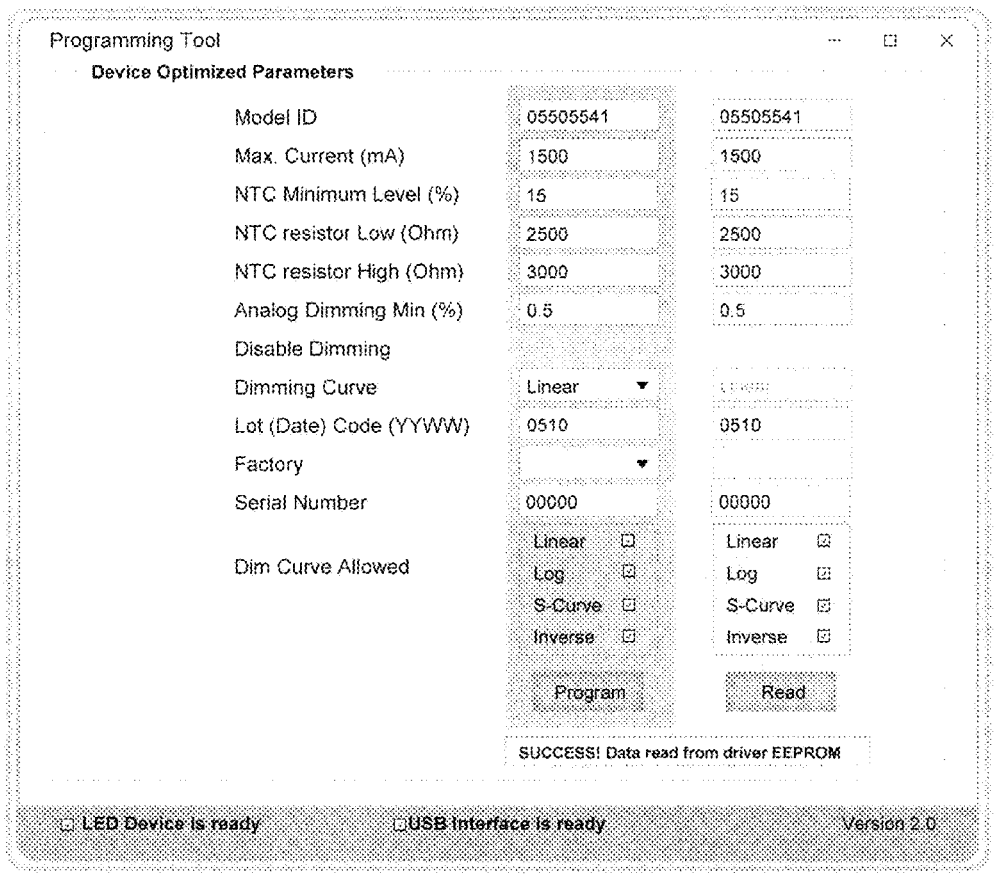
FIG. 5 is a sample GUI screen.

A sample GUI screen on a programming tool, as seen in FIG. 5, can have a screen for device optimized parameters or variables. For example, parameters or variables can be read from the EEPROM on a right-hand column when the user clicks on a read button in the right-hand column, and then the user can change the parameters or variables on a left-hand column when a user clicks on a program button on the left-hand column. A variety of different parameters or variables can include a model ID, and maximum current in milliamps, and NTC minimum level, an NTC resistor low setting in Ohms, an NTC resistor high setting in Ohms, an analog dimming minimum percentage, a checkbox for disabling dimming, a selection drop-down menu for selecting a dimming curve, a lot and date code, a factory identifier, a serial number, and also have checkboxes for the dimming curves allowed. The checkboxes can include a checkbox for a linear dimming curve, a checkbox for a logarithmic dimming curve, a checkbox for an S-curve dimming curve, and a checkbox for an inverse dimming curve. The programming tool can also have an output message field such as providing a message such as "SUCCESS! Data read from driver EEPROM" when data is successfully read from the EEPROM. Indicators can also be provided in the programming tool window at a bottom of the programming tool GUI screen. For example the indicators could indicate that the LED device is ready, or indicate that the USB interface is ready. The version number can be placed in the lower right-hand corner to indicate the version of the programming tool, such as version 2.0.

The GUI software can run a setup.exe program to install the appropriate USB to I2C interface Windows™ drivers. Once the driver is properly installed, the GUI program can read EEPROM parameters or variables, then allow user modification, and allow user to click the "Program" button to change the parameters or variables on the programmable LED Driver. A USB-to-I2C interface adapter is required for physical electrical connection between a personal computer and the integrated circuit. After this adapter converts USB DATA+ and DATA− signals, the USB input connector on the programmable LED Driver has I2C (inter-integrated circuit, read "I-square-C") with Serial Data (SDA) and Serial Clock (SCL) signals to feed to the Microcontroller U4 105 to handle the EEPROM parameters or variables read and program function. Besides the SDA, SCL and the ground wires, there is a +5 VDC available on the USB input connector that can continue to the I2C. Therefore, during the read, modify and re-program, the I2C can be powered by the +5 VDC power source such that no other power source is required.

The present invention has an NTC thermal protection system that includes an optional user installed Negative Temperature Coefficient (NTC) resistor NTC 133. The present invention LED Driver has an optional user supplied NTC Resistor at input connector J6. With the NTC Resistor properly selected, the user can define and program the over temperature derating protection, using either factory default settings or user defined settings by use of the GUI software. The factory default settings are predetermined NTC resistance values, and typically NTC low resistance being set up at 2K Ohm defines the temperature derating ends with a minimum LED output current limited at 10%. The Microcontroller has an analog input port (with internal Analog to Digital Converter or ADC) to read the NTC resistance at the input connector J6 with a known value pull up resistor Rntc1 138 to Microcontroller power supply, 3.3 VDC. If the NTC resistance is read below 2K Ohm, then the Microcontroller will set the LED output current to 10% maximum or the GUI programmed minimum value.

If a factory typically has an NTC high resistance selected at 6.3K Ohm. If the NTC resistance is read above 6.3K Ohm, then the LED output current will be set at the maximum 100%, or otherwise selected by other functions such as Rset, or 0-10 VDC dimming input voltage. When the NTC resistor is heated due to ambient environment, or by the heat of LED lamps and the LED driver itself, the NTC resistance will drop (per NTC manufacturer's spec). When NTC resistance is read below 6.3K Ohm by the Microcontroller firmware continuous reading NTC function, the maximum LED output current will begin to drop, or fall back for temperature derating mechanism. In the internal EEPROM data table area, the Microcontroller keeps a formula which describes the corresponding LED current percentage % levels with respect to the continuous resistance dropping of NTC resistor. This formula defines the smooth derating curve, until it finally reaches the minimum NTC resistance at 2K Ohm or as set by GUI with only 10% LED current. The GUI shown above has the 3 programmable NTC parameters or variables: NTC Minimum Level (%), NTC Resistor Low (Ohm) and NTC Resistor High (Ohm). The user can modify these parameters or variables and with properly selected NTC component, the LED driver is then capable of user defined temperature derating function.

Transition-Mode PFC Controller U2 101 receives power from the AC side and provides a primary side regulation. The intelligent step-down LED driver chip U1 102 provides power to an external LED load 110. The IADJ pin U2 106 on the intelligent step-down LED driver chip U1 102 provides current adjustment. An analog dimming signal Analog_Dim 107 as well as a PWM dim signal PWM_Dim 108 are both received from the programming and signal side of the circuit. An LED positive terminal output LED+_OUT 117 provides correct output voltage at connector J4. U1 102 VOUT pin 134 is a Voltage Reference Pin which is maintained at approximately 3.0 VDC. A first voltage output resistor Rvout1 135 and a second voltage output resistor Rvout2 136 are connected to the voltage output of the intelligent step-down LED driver chip U1 102. The LED+_OUT 117 voltage is determined by the 2 resistors values of Rvout1 135 and Rvout2 136, to satisfy the U1 102 VOUT pin 134 to be maintained at approximately 3.0 VDC.

Figure 3:
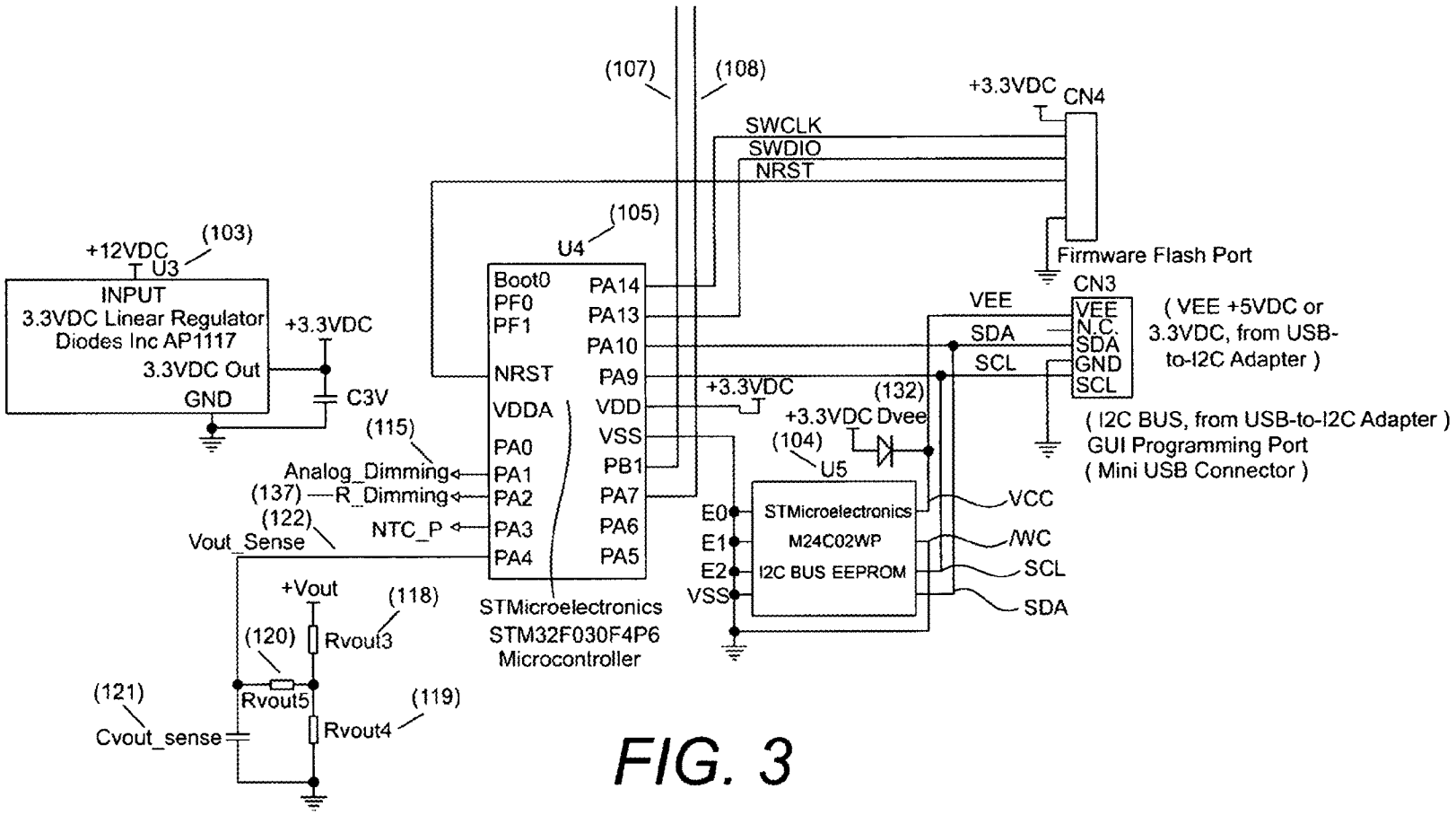
FIG. 3 is a circuit diagram of the present invention showing the companion microcontroller and the configuration for the programming and signals including features such as the configurable EEPROM that provides a memory for storage of various preconfigured settings.

The RC Network 109 is shown as a rectangular block and provides a signal filter to filter the Analog_Dim signal 107 from FIG. 3 Microcontroller U4 pin PB 1. The U4 chip can only output a digital ON/OFF pulse-width-modulation (PWM) signal. This RC Network 109 is designed to filter the ON/OFF PWM signal into a true "analog signal". This RC Network 109 uses resistors and capacitors all having a suffix "ad" so as to relate to the Analog_Dim signal 107. The RC Network 109 has double RC filters: Rad1/Cad1 and Rad2/Cad2, then a pair of voltage divider resistors Rad3/Rad5, then another RC filter Rad4/Cad3. The output of the RC Network 109 is fed to junction of resistors Riadj1 128 and Riadj3 129. If without the RC Network 109, the LED output current will be fixed and not adjustable. The LED current is determined by the U1 102 internal generated approximately 3.0 VDC reference voltage at VREF pin 130. The VREF 130 voltage is divided down by resistors Riadj1 128 and Riadj3 129 (in series), and with Riadj2 131 to ground. The junction of Riadj3 129 and Riadj2 131 is connected to U1 102 current adjustment pin IADJ 106 to determine the LED maximum current.

Now, with the RC Network 109 output signal (junction of RC filter resistor Rad4 and capacitor Cad3) to be connected at the junction of Riadj1 128 and Riadj3 129. Any slight voltage variation of the RC Network 109 output signal, will affect the LED output current. This is the "primary" current adjustment function.

Figure 2:
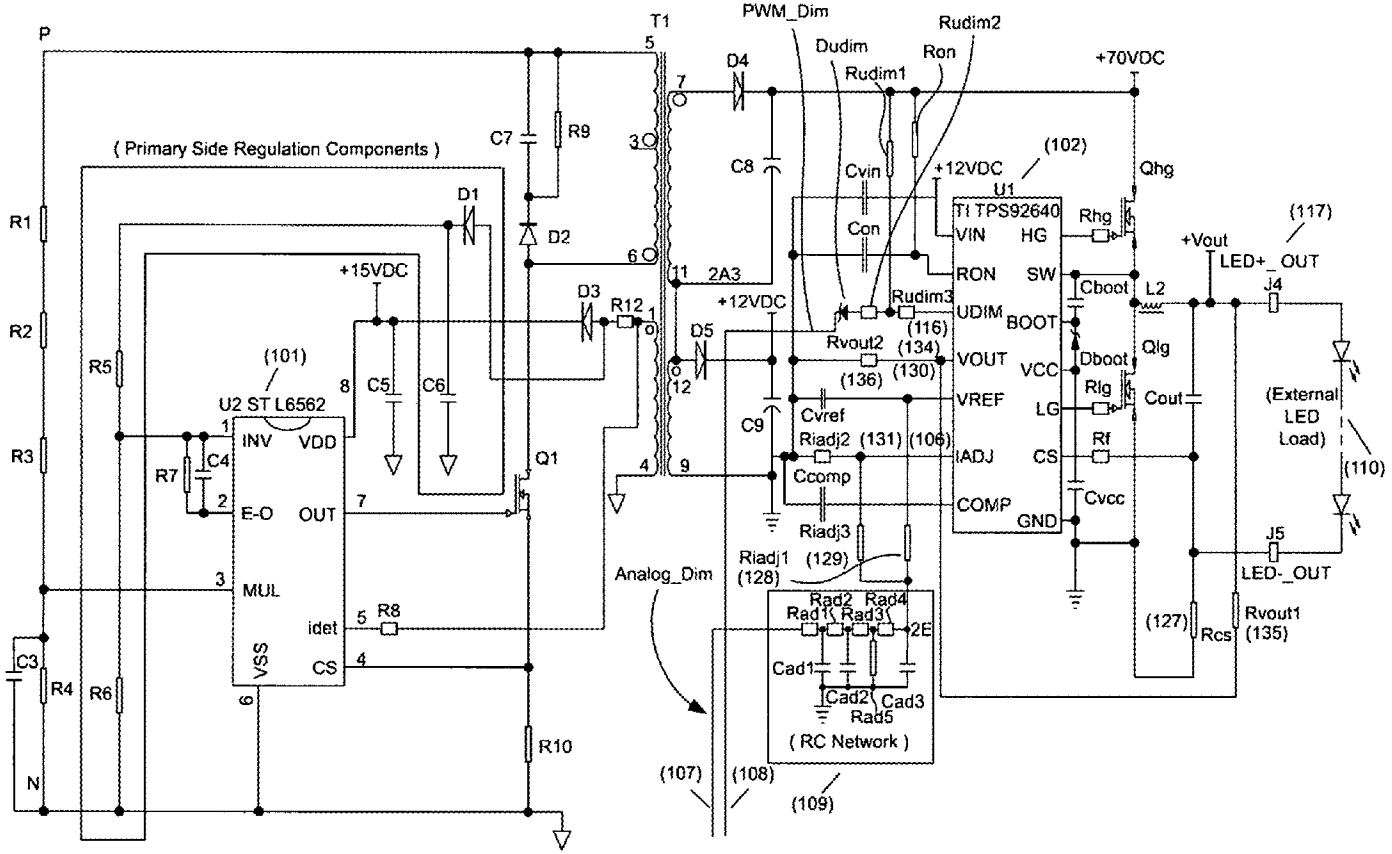
FIG. 2 is a circuit diagram of the present invention showing the DC side and including features such as a LED Driver Controller for the primary side, and a second stage intelligent step-down LED driver chip.

A "reference voltage output" in FIG. 2 on the intelligent step-down LED driver chip U1 102 is at the $4^{th}$ pin "VOUT" 134 from the upper-left corner. To relate the five resistors in connection with this VOUT pin, these five resistors as labeled as Rvout1 through Rvout5. Rvout1 and Rvout2 are a pair or divider resistors to program the "LED+_OUT" voltage at connector J4, with assigned "netlist name" as "+Vout". The junction point of Rvout1 and Rvout2 is connected to the intelligent step-down LED driver chip 102 U1 $4^{th}$ pin "VOUT" 134.

In FIG. 3 lower-left corner, The microcontroller U4 105 can read the LED+_OUT 117 voltage at netlist name "+Vout" by voltage divider resistors Rvout3 118 and Rvout4 119 (to lower below 3.3 VDC to avoid damages to U4 105). This divided down voltage is filtered by RC filters Rvout5 120 and Cvout_sense 121, as signal name Vout_Sense 122, then feed to microcontroller U4 105 analog input pin "PA4". With known values of voltage divider resistors Rvout3 118 and Rvout4 119, microcontroller U4 105 firmware can figure out that the LED+_OUT 117 voltage matches the desired output voltage. If LED+_OUT 117 voltage is higher than nominal tolerance level, it can send the shutdowm command by set U5 105 output pin PA7, which is the PWM_Dim signal 108 continuously logic 0, or 0 VDC. The only safe way to recover from the shutdowm mode is to power off and then back on the AC input power source.

Regulator U3 103 can be a Diodes Incorporated™ part number AP1117 which is a low dropout positive adjustable or fixed-mode regulator at 3.3 VDC output with 1A output current capability. The external EEPROM U5 104 can be provided by a part such as STMicroelectronics™ part number M24C02WP. Microcontroller U4 105 can be provided such as STMicroelectronics™ part number STM32F030F4P6. The microcontroller can receive an analog dimming signal Analog_Dimming 115 which comes from FIG. 4 top side of capacitor Cadim 114. The dimming signal is scaled from 10 VDC at connector J8, down to 3.3V (by voltage divider resistors Radim2 112 and Radim3) as an input signal for U4 105 pin PA1, not to be confused with the Analog_Dim 107 output signal from U4 105 pin which is called "PB1".

Figure 4:
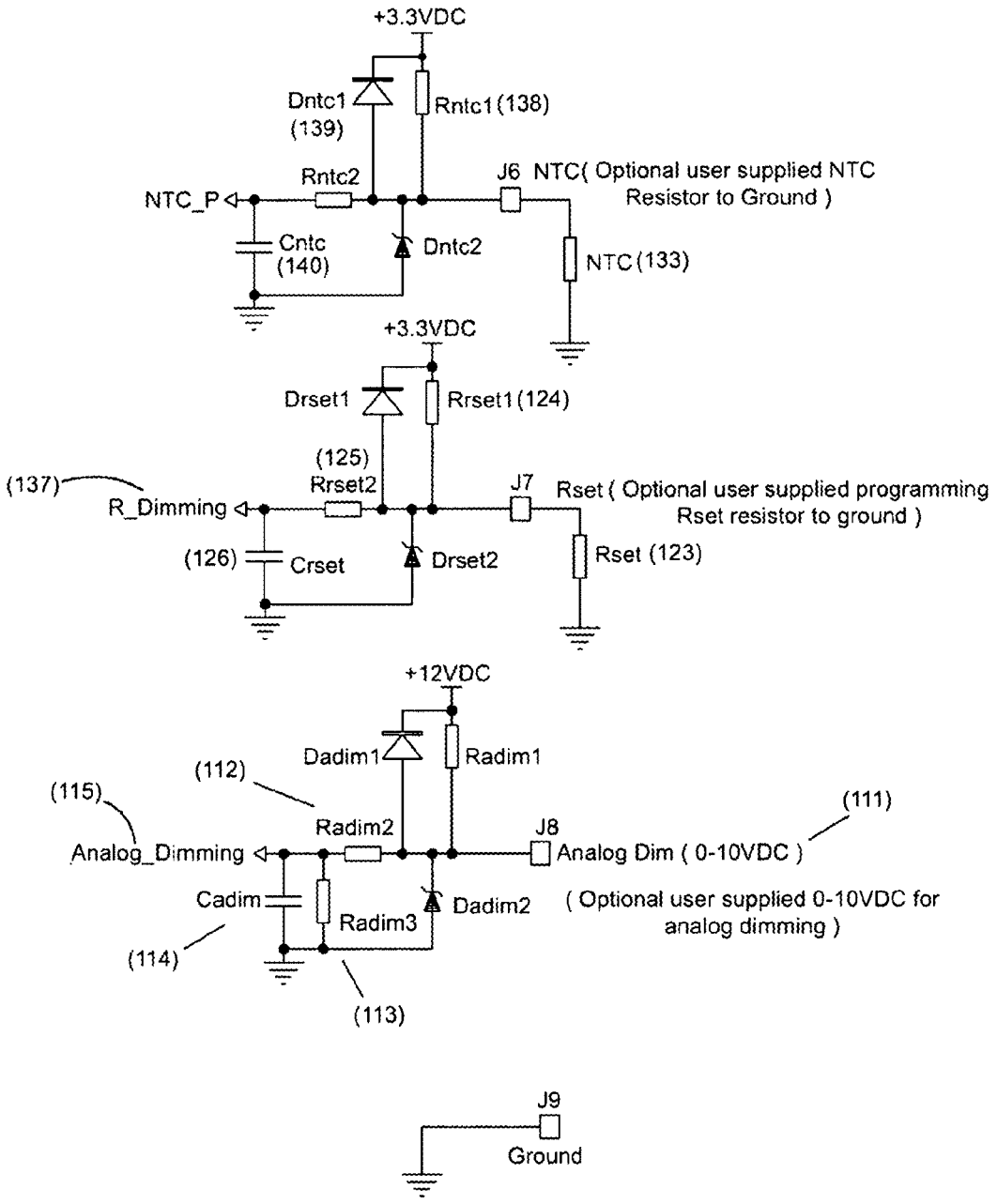
FIG. 4 is a circuit diagram of input ports for providing settings for the LED driver.

FIG. 4 shows inputs signals from sensors. A Dntc1 Protection Diode 139 works with the Rntc1 Pull up resistor 138 to pull up to 3.3 V. A NTC Negative Temperature Coefficient Resistor 133 is an optional user provided as a Temperature Sensor. Cntc 140 Noise Filter for NTC_P output to processor 140 is a capacitor that filters noise. LED current set resistor Rset 123 is a user supplied resistor that sets the value for LED output current programming. Rrset1 Pull up resistor 124 pulls up Rset 123 at connector J7 to 3.3 VDC voltage. Rrset2 low-pass resistor 125 works with Crset low-pass capacitor 126 to make a low-pass filter to filter noise that may have occurred during voltage reading of R_Dimming signal 137. Radim2 resistor voltage divider 112, Radim3 resistor voltage divider 113 and Cadim noise filter 114 provide voltage dividing and signal cleaning function for signal Analog_Dimming 115.

Analog Dim (0-10 VDC) 111 should not to be confused with FIG. 2 "Analog_Dim" signal 107, which is output on U4 105 pin "PB1". FIG. 4 connector J8 is "Analog Dim (0-10 VDC)", the industrial standard 0 VDC min and 10 VDC max dimming voltage. The 10 VDC is too high for a 3.3 VDC microcontroller. Adapting the voltage requires first dividing down the voltage by resistors such as resistors Radim2 112 and Radim3 113.

The invention claimed is:

1. An LED driver comprising:

a. a first stage, wherein the first stage converts AC power from an AC power source into a DC power source; and b. a second stage receiving the DC power source from the first stage and further comprising:

i. a second stage step-down buck converter with a constant current output that receives power from the DC power source;

ii. a second stage intelligent step-down LED driver chip that runs a step down buck converter that produces the constant current output to the external LED load;

iii. a microcontroller for controlling the second stage intelligent step down LED driver chip, wherein the microcontroller provides programmable features for a user, wherein the programmable features provide user programmable variables to reprogram the LED driver to alter default variables, wherein the microcontroller further includes multiple input/output (I/O) pins for communication, wherein the microcontroller reads a user supplied resistor Rsct to obtain an Rsct value for LED current programming setting, wherein the microcontroller reads a 0-10 VDC analog dimming signal, and wherein the microcontroller reads a negative temperature coefficient (NTC) resistor for programmable temperature derating, and wherein a firmware determines an LED current setting by an internal data table in EEPROM, wherein an LED current setting on the microcontroller provides a pulse width modulation signal, filtered by a resistor-capacitor network, to the second stage intelligent step down LED driver chip's current analog dimming output pin IADJ.

2. The LED driver of claim 1, wherein if the Rsct value is less than 8.3K Ohm, a programmable output current function, determined by the Rsct value and internal Firmware EEPROM data, and the 0-10 VDC analog dimming function, overrides the default graphic user interface (GUI) LED current settings.

3. An LED driver comprising:

a. a first stage, wherein the first stage converts AC power from an AC power source into a DC power source; and b. a second stage receiving the DC power source from the first stage and further comprising:

i. a second stage step-down buck converter with a constant current output that receives power from the DC power source;

ii. a second stage intelligent step-down LED driver chip that runs a step down buck converter that produces the constant current output to the external LED load;

iii. a microcontroller for controlling the second stage intelligent step down LED driver chip, wherein the microcontroller provides programmable features for a user, wherein the programmable features provide user programmable variables to reprogram the LED driver to alter default variables, wherein, the user input 0-10 VDC analog dimming is also read by the microcontroller, which is converted into a PWM signal, per 4 types of available dimming curves and then sent to an LED Driver chip analog dimming control pin IADJ, which controls an LED output current accordingly.

4. The LED driver of claim 3, wherein the microcontroller has an EEPROM that provides a data table storage olfactory default and user programmable parameters, wherein programmable parameters can be read and modified, then reprogrammed by a graphic user interface (GUI) software program via a universal serial bus port on a computer with a USB to I2C interface converter, wherein the USB-to-I2C interface converter outputs I2C communication signals as SDA and SCL to the microcontroller to control LED output or alter the programmable data in the EEPROM data area.

5. The LED driver of claim 3, wherein a graphic user interface software can communicate with the LED driver to read existing programmable parameters, wherein a microcontroller EEPROM data table stores programmable parameters including: a maximum LED current parameter that is no higher than a buck converter hardware design limit, and an Rset value or 0-10 VDC analog dimming input voltage.

6. An LED driver comprising: a. a first stage, wherein the first stage converts AC power from an AC power source into a DC power source; and b. a second stage receiving the DC power source from the first stage and further comprising: i. a second stage step-down buck converter with a constant current output that receives power from the DC power source; ii. a second stage intelligent step-down LED driver chip that runs a step down buck converter that produces the constant current output to an external LED load; iii. a companion microcontroller for controlling the second stage intelligent step down LED driver chip, wherein the microcontroller provides programmable features for a user, wherein the programmable features provide user programmable variables to reprogram the LED driver to alter default variables, wherein an negative temperature coefficient (NTC) resistor controls programmable temperature derating, wherein the microcontroller continuously reads the resistance value of the NTC resistor on the input connector, wherein if the NTC resistor is not installed, or is installed but the value is higher than the default maximum of 6.3K Ohm or a user programmed new value via a graphic user interface (GUI), the LED output current is in normal mode which is determined by an Rset value or 0-10V analog dimming input voltage, wherein when an ambient temperature increases and an NTC resistance value drops below a maximum value, then the microcontroller reduces the LED output current into a temperature derating mode according to an internal EEPROM data table and an NTC temperature resistance value.

7. The LED driver of claim 6, wherein the NTC temperature derating is programmable via GUI, to select a maximum resistance at which the LED current begins to decrease, and to select a minimum resistance at which the LED current is held to a minimum value.

* * * * *